US008616542B2

(12) United States Patent
Min et al.

(10) Patent No.: US 8,616,542 B2
(45) Date of Patent: Dec. 31, 2013

(54) PRINT-MEDIUM POST-TREATMENT APPARATUS AND CONTROL METHOD THEREOF

(75) Inventors: Ji Hoon Min, Yongin-si (KR); Hyun Woo Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 301 days.

(21) Appl. No.: 12/929,872

(22) Filed: Feb. 22, 2011

(65) Prior Publication Data

US 2011/0217147 A1 Sep. 8, 2011

(30) Foreign Application Priority Data

Mar. 4, 2010 (KR) ..... 10-2010-0019375

(51) Int. Cl.
*B65H 37/06* (2006.01)

(52) U.S. Cl.
USPC ..... 270/45; 270/32; 270/58.08

(58) Field of Classification Search
USPC ..... 270/32, 45, 58.07, 58.08
See application file for complete search history.

(56) References Cited

U.S. PATENT DOCUMENTS

| | | | | |
|---|---|---|---|---|
| 4,135,616 | A | 1/1979 | Pellaton | |
| 4,718,656 | A | 1/1988 | Reist | |
| 5,000,657 | A | 3/1991 | Gunther, Jr. | |
| 5,289,251 | A | 2/1994 | Mandel et al. | |
| 6,152,443 | A * | 11/2000 | Claramunt et al. | 271/258.05 |
| 6,655,680 | B1 * | 12/2003 | Huang et al. | 271/152 |
| 6,926,272 | B2 * | 8/2005 | Carter et al. | 271/258.01 |
| 7,021,622 | B2 * | 4/2006 | Carter et al. | 271/258.01 |
| 7,665,731 | B2 * | 2/2010 | Shingai | 271/265.02 |
| 7,802,799 | B1 * | 9/2010 | Semmes | 277/627 |
| 2003/0227126 | A1 * | 12/2003 | Huang et al. | 271/110 |
| 2005/0035540 | A1 * | 2/2005 | Carter et al. | 271/303 |
| 2005/0051949 | A1 * | 3/2005 | Carter et al. | 271/258.01 |
| 2006/0087070 | A1 * | 4/2006 | Cook et al. | 271/145 |
| 2008/0214377 | A1 * | 9/2008 | Kamiya | 493/421 |
| 2008/0237964 | A1 | 10/2008 | Kiriyama | |

FOREIGN PATENT DOCUMENTS

| | | |
|---|---|---|
| EP | 0059450 | 9/1982 |
| JP | 2005-126169 | 5/2005 |

OTHER PUBLICATIONS

Extended European Search Report issued Oct. 18, 2012 in corresponding European Patent Application No. 11155659.3.
Extended European Search Report dated Jul. 9, 2013 in European Patent Application No. 13168810.3.

* cited by examiner

*Primary Examiner* — Patrick Mackey
(74) *Attorney, Agent, or Firm* — Staas & Halsey LLP

(57) ABSTRACT

A print-medium post-treatment apparatus and a control method thereof, to increase the number of print media stacked on a bookbinding stack tray by controlling operation of a conveyor belt. The a print-medium post-treatment apparatus includes a bookbinding stack tray including a tray sensor to sense a print medium and a conveyor belt to move the print medium, and a controller to move the print medium in a given discharge direction by operating the conveyor belt in a first direction if the tray sensor senses the print medium moved onto the bookbinding stack tray and to move the print medium in an opposite direction of the discharge direction by operating the conveyor belt in a second direction so as to reduce a distance between a previously discharged print medium and a subsequently discharged print medium.

10 Claims, 16 Drawing Sheets

PRINT-MEDIUM POST-TREATMENT APPARATUS AND CONTROL METHOD THEREOF

CROSS-REFERENCE TO RELATED APPLICATIONS

This application claims the benefit of Korean Patent Application No. 2010-019375, filed on Mar. 4, 2010 in the Korean Intellectual Property Office, the disclosure of which is incorporated herein by reference.

BACKGROUND

1. Field

Embodiments relate to a print-medium post-treatment apparatus having a bookbinding device to bind print media transmitted from an image forming apparatus.

2. Description of the Related Art

In general, a print-medium post-treatment apparatus is arranged parallel to an image forming apparatus. In one example, a print-medium post-treatment apparatus contains a punch or stapler to perform a punching or stapling operation on a print medium, on which an image has been completely formed, transmitted from an image forming apparatus.

Some recent print-medium post-treatment apparatuses include a bookbinding device in which a plurality of print media transmitted from an image forming apparatus is centrally folded into two and is bound to form a book, such as a booklet.

The bookbinding device includes a stapler to staple the center of the print media, a pair of press rollers arranged to face each other, and a folding knife installed to be forwardly or rearwardly movable so as to be introduced into a gap between the two press rollers. In operation, after the stapler staples the center of the print media, the folding knife moves into the gap between the press rollers, folding the print media into two on the basis of the stapled center of the print media, whereby bookbinding of the print media is completed.

SUMMARY

It is an aspect to provide a print-medium post-treatment apparatus to allow an increased quantity of print media discharged from a bookbinding device to be stacked on a bookbinding stack tray and a control method thereof.

Additional aspects will be set forth in part in the description which follows and, in part, will be apparent from the description, or may be learned by practice of the invention.

In accordance with one aspect, a print-medium post-treatment apparatus includes a bookbinding stack tray including a tray sensor to sense a print medium discharged from a bookbinding device, a conveyor belt to move the print medium, and a motor to operate the conveyor belt, and a controller to move the print medium onto the bookbinding stack tray in a given discharge direction by operating the conveyor belt in a first direction if the tray sensor senses the print medium, and to move the print medium in an opposite direction of the discharge direction by operating the conveyor belt in a second direction so as to reduce a distance between a previously discharged print medium and a subsequently discharged print medium.

The tray sensor may include a light emitting element to irradiate light, a light receiving element to receive the irradiated light, and a flag movably installed between the light emitting element and the light receiving element.

The tray sensor may sense the print medium discharged from the bookbinding device onto the bookbinding stack tray when the print medium pushes the flag.

The print medium discharged onto the bookbinding stack tray may be sensed as the light irradiated from the light emitting element is intercepted or is transmitted to the light receiving element when the print medium pushes the flag.

The controller may move the print medium in the discharge direction by operating the conveyor belt for a first time starting from a time when the print medium releases the flag from a pushed state.

The controller may move the print medium in the opposite direction of the discharge direction for a second time after the print medium is moved in the discharge direction for the first time.

In accordance with another aspect, a control method of a print-medium post-treatment apparatus includes sensing a print medium discharged from a bookbinding device onto a bookbinding stack tray, moving the print medium in a given discharge direction by operating a conveyor belt of the bookbinding stack tray in a first direction if the print medium is sensed, and moving the print medium in an opposite direction of the discharge direction by operating the conveyor belt in a second direction so as to reduce a distance between a previously discharged print medium and a subsequently discharged print medium.

The movement of the print medium via operation of the conveyor belt in the first direction may include operating the conveyor belt for a predetermined time starting from a time when the print medium discharged from the bookbinding device onto the bookbinding stack tray is sensed, thereby moving the print medium in the discharge direction.

The movement of the print medium in the opposite direction of the discharge direction via operation of the conveyor belt in the second direction may include operating the conveyor belt in the second direction for a predetermined time after the conveyor belt is operated in the first direction for the predetermined time.

The bookbinding stack tray may be provided with a tray sensor, and the conveyor belt may be operated in the first direction if the tray sensor senses the print medium.

It may be confirmed whether or not the tray sensor does not sense the print medium, and the conveyor belt may be operated in the first direction for the predetermined time starting from a time when the tray sensor does not sense the print medium.

The conveyor belt may be operated in the second direction for the predetermined time to move the print medium in the opposite direction of the discharge direction after the conveyor belt is moved in the first direction for the predetermined time.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
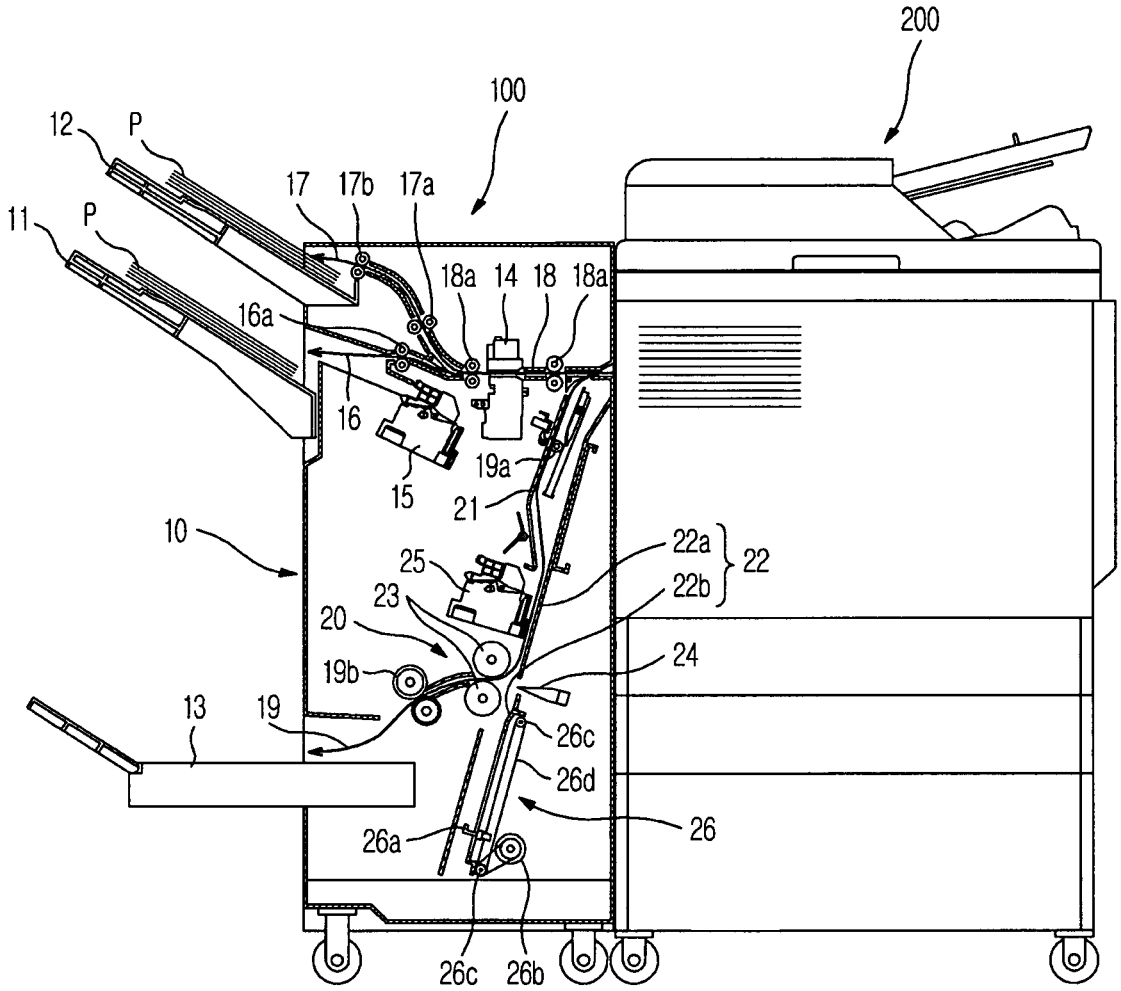
FIG. 1 is a sectional view illustrating a schematic configuration of a print-medium post-treatment apparatus according to an exemplary embodiment.

Reference will now be made in detail to the exemplary embodiment, examples of which are illustrated in the accompanying drawings, wherein like reference numerals refer to like elements throughout.

Figure 2:
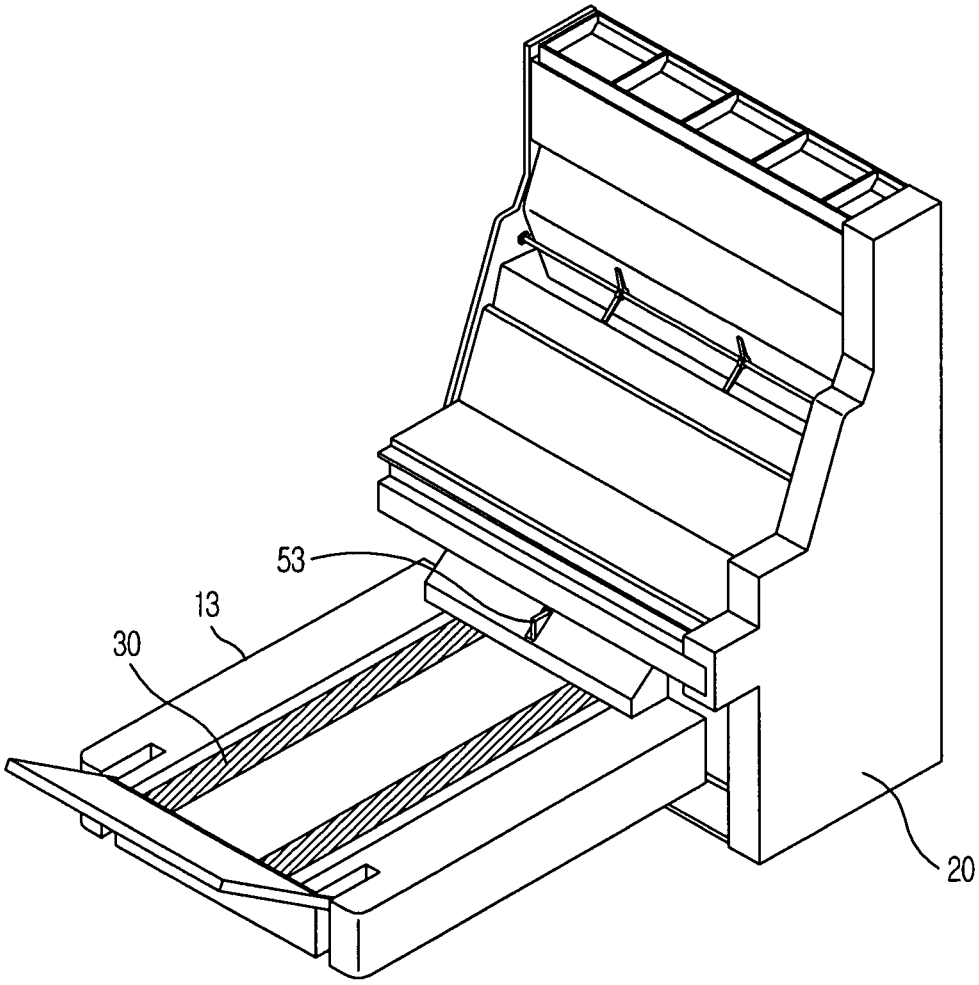
FIG. 2 is a top perspective view of the print-medium post-treatment apparatus according to the exemplary embodiment.
Figure 3:
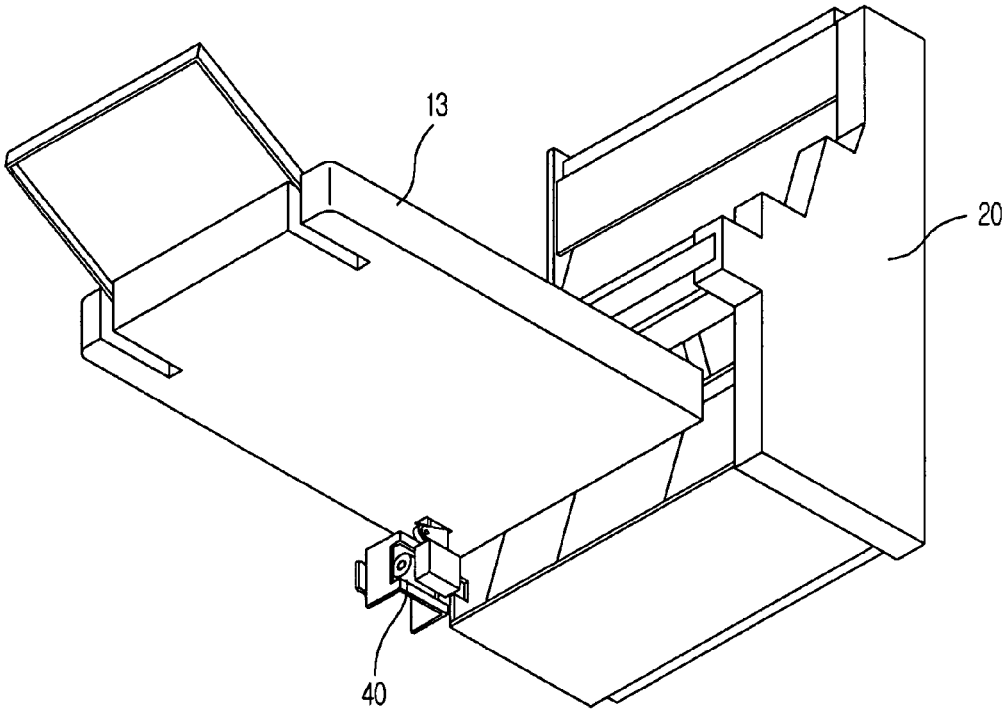
FIG. 3 is a bottom perspective view of the print-medium post-treatment apparatus according to the exemplary embodiment.

FIG. 1 is a sectional view illustrating a schematic configuration of a print-medium post-treatment apparatus according to an exemplary embodiment, and FIGS. 2 and 3 are respectively a top perspective view and a bottom perspective view of the print-medium post-treatment apparatus according to the exemplary embodiment.

As illustrated in FIGS. 1 to 3, the print-medium post-treatment apparatus 100 according to the exemplary embodiment is coupled to a side of an image forming apparatus 200. The print-medium post-treatment apparatus 100 may be designed to perform, e.g., a bookbinding operation, a punching operation, and a stapling operation on a plurality of print media P, on each of which an image has been completely formed, transmitted from the image forming apparatus 200. The bookbinding operation is an operation to fold the print media P into two on the basis of the center thereof and bind the folded print media P to form a book. The punching operation is an operation to punch holes required to bind the print media P, and the stapling operation is an operation to bind the plurality of print media P together.

The print-medium post-treatment apparatus 100 includes a body 10 defining an outer appearance of the apparatus 100, one side of which is connected to the image forming apparatus 200, and a plurality of stack trays 11, 12 and 13 provided at the other side of the body 10 so that print media P, which have been subjected to post-treatment, are stacked on the stack trays 11, 12 and 13.

The print-medium post-treatment apparatus 100 may further include e.g., a bookbinding device 20 for use in the bookbinding operation, a punch 14 for use in the punching operation, and a stapler 15 for use in the stapling operation, which are accommodated in the body 10.

The plurality of stack trays 11, 12 and 13 includes a first stack tray 11 to support standard sized paper thereon, a second stack tray 12 arranged above the first stack tray 11 to support print media P having a predetermined size or more or relatively thick print media P such as envelopes thereon, and a bookbinding stack tray 13 arranged below the first stack tray 11 to support a stack of print media P that have bound by the bookbinding device 20 within the body 10.

A plurality of delivery paths 16, 17, 18 and 19 is defined in the body 10 to guide the print media P to the plurality of stack trays 11, 12 and 13. The delivery paths include a first delivery path 16 to guide the print media P to the first stack tray 11, a second delivery path 17 to guide the print media P to the second stack tray 12, a main delivery path 18 to guide the print media P transmitted from the image forming apparatus 200 to a junction of the first delivery path 16 and the second delivery path 17, and a bookbinding delivery path 19 serving not only to guide the print media P from the image forming apparatus 200 to the bookbinding device 20, but also to guide the completely bound print media P to the bookbinding stack tray 13.

The punch 14 is located on a position of the main delivery path 18 to punch the print media P moving along the main delivery path 18. The stapler 15 is located on a position of the first delivery path 16 to staple the print media P moving along the first delivery path 16.

A plurality of delivery rollers 17*a*, 18*a*, and 19*a* and a plurality of discharge rollers 16*a*, 17*b*, 18*b* and 19*b* are installed on the delivery paths 16, 17, 18 and 19, to guide the print media P to the stack trays or discharge the print media P from the stack trays.

The bookbinding device 20, as illustrated in FIGS. 1 to 3, includes a guide plate 21, a stack plate 22, a pair of press rollers 23, a folding knife 24, and a bookbinding stapler 25. The guide plate 21 obliquely extends so that the print media P transmitted from the image forming apparatus 200 drops under guidance of a lower surface of the guide plate 21. The stack plate 22 is located below the guide plate 21 to obliquely extend by an inclination angle corresponding to that of the guide plate 21, so that the print media P, dropped from the guide plate 21, are stacked on an upper surface of the stack plate 22. The pair of press rollers 23 is arranged to face each other so that one of the press rollers 23 is located on the upper surface of the stack plate 22 and the other one is located in front of the stack plate 22. The folding knife 24 is forwardly or rearwardly movably installed to the stack plate 22. As the folding knife 24 protrudes from the stack plate 22 to enter between the pair of press rollers 23, the print media P on the stack plate 22 are folded into two on the basis of the center thereof by the folding knife 24. The bookbinding stapler 25 is arranged above the press rollers 23 to bind the print media P together by stapling the center of the print media P. In the present embodiment, the stack plate 22 consists of an upper stack plate 22*a* and a lower stack plate 22*b*, which are located above and below the folding knife 24.

In addition, the bookbinding device 20 includes a lifting device 26 to vertically change a stack position of the print media P on the stack plate 22 according to a size of the print media P. The lifting device 26 includes a lifting member 26*a* vertically movably installed to the lower stack plate 22*b* to support lower ends of the print media P on the lower stack plate 22*b*, a forwardly or reversely rotatable lifting motor 26*b*, a pair of lifting pulleys 26*c* arranged at opposite sides of the lifting member 26*a* on the basis of a lifting direction, and a lifting belt 26*d* both ends of which are supported on the pair of lifting pulleys 26*c*. The lifting member 26*a* is installed to the lower stack plate 22*b* so as to be obliquely movable up and down along an inclined path corresponding to the inclination angle of the lower stack plate 22*b*. The lifting member 26*a* is also connected to the lifting belt 26*d* and is moved up or down according to a rotating direction of the lifting motor 26*b*, thereby acting to vertically change a stack position of the print media P the lower ends of which are supported thereon.

Accordingly, the print media P transmitted from the image forming apparatus 200 drop onto the stack plate 22 under guidance of the guide plate 21. After a preset number of print media P is stacked on the stack plate 22, the bookbinding stapler 25 staples the center of the print media P. The lifting device 26 moves the completely stapled print media P downward and thereafter, the folding knife 25 and the pair of press rollers 23 fold the print media P into two on the basis of the center of the print media P. In this way, the bookbinding operation of the print media P in the bookbinding device 20 is completed.

The completely bound print media P are discharged from the bookbinding device 20 and are stacked on the bookbinding stack tray 13. The bookbinding stack tray 13 includes a conveyor belt 30 to move the print media P bi-directionally, a motor 40 to drive the conveyor belt 30, and a tray sensor 50 to sense the presence of the print media P entering the bookbinding stack tray 13. In an embodiment, the conveyor belt 30 may be controlled to move bi-directionally, in order to increase the number of print media P stacked on the bookbinding stack tray 13. Hereinafter, a bi-directional movement control method will be described in detail.

Figure 4:
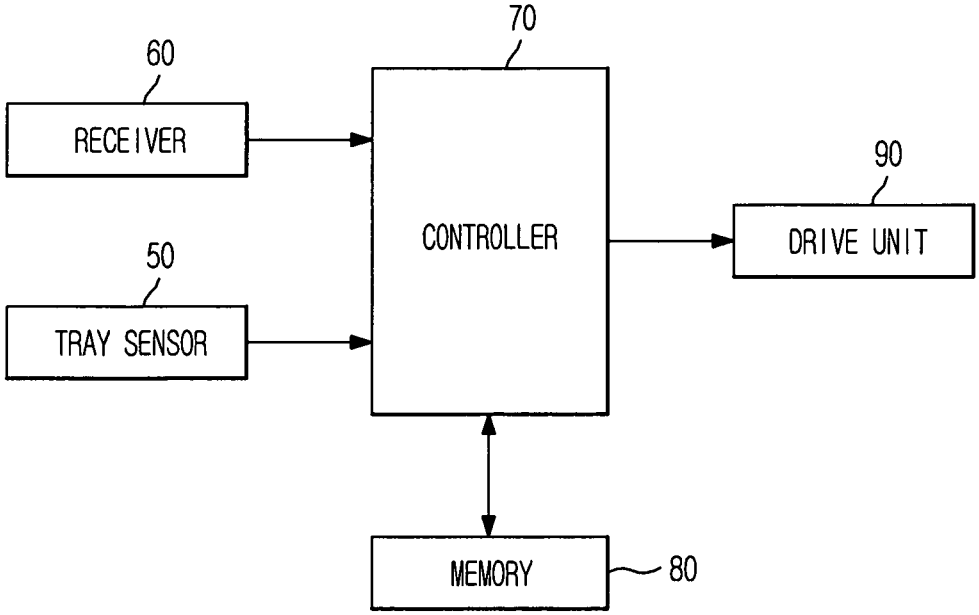
FIG. 4 is a control block diagram of the print-medium post-treatment apparatus according to the exemplary embodiment.

FIG. 4 is a control block diagram of the print-medium post-treatment apparatus according to the exemplary embodiment.

The print-medium post-treatment apparatus includes a receiver 60 to receive signals from the image forming apparatus 200, the tray sensor 50 installed at one side of the bookbinding stack tray 13 to sense movement of the print media P, a controller 70 to control bi-directional movement of the conveyor belt 30 so as to increase the number of print media P stacked on the bookbinding stack tray 13, a memory 80 to store drive time information of the conveyor belt 30, and a drive unit 90 to allow the motor 40 connected to the conveyor belt 30 to perform bi-directional driving under the control of the controller 70.

Figure 8:
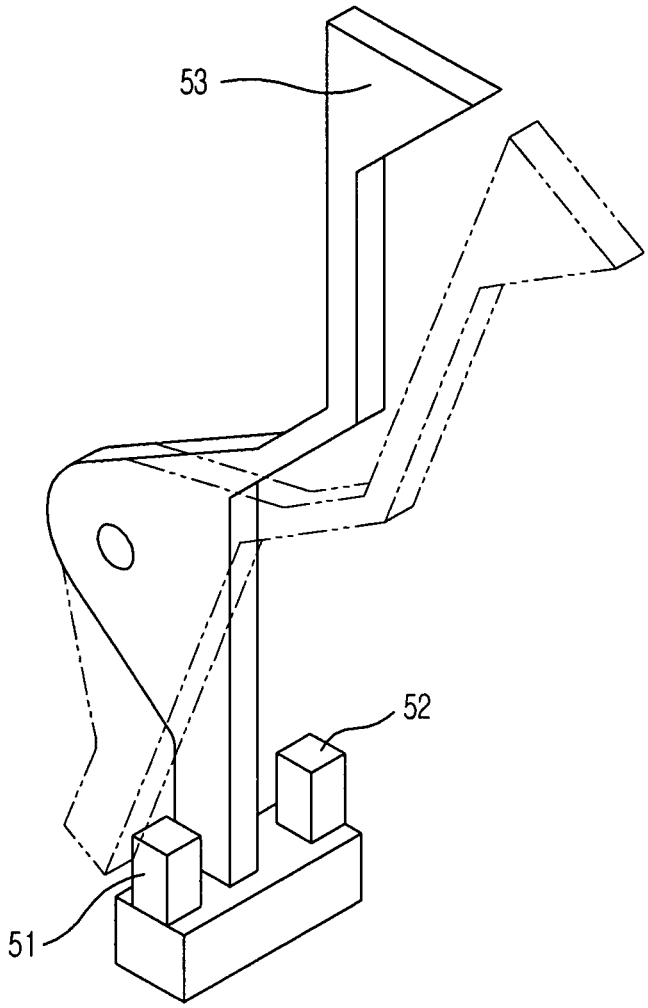
FIG. 8 is a view illustrating operation of a tray sensor according to the exemplary embodiment.

The tray sensor 50 is installed at one side of the bookbinding stack tray 13. Referring to FIG. 8, the tray sensor 50 includes a light emitting element 51 to irradiate light, a light receiving element 52 to receive the irradiated light, and a flag 53 movable between the light emitting element 51 and the light receiving element 52. The flag 53 serves to intercept the light irradiated from the light emitting element 51 or release interception of the light. More specifically, if the completely bound print media P, i.e. a stack of bound print media P discharged from the bookbinding device 20 begins to enter the bookbinding stack tray 13, the flag 53 installed at one side of the bookbinding stack tray 13 is pushed and moved by the print media P, thereby acting to intercept the light emitted from the light emitting element 51 or release interception of the light. Specifically, if the flag 53 intercepts the light that would otherwise be transmitted from the light emitting element 51 to the light receiving element 52 prior to being pushed, interception of the light will be released once the flag 53 is pushed. On the other hand, if the flag 53 does not intercept the light irradiated from the light emitting element 51 prior to being pushed, the light will be intercepted so as not to be transmitted to the light receiving element 52 once the flag 53 is pushed.

The controller 70 senses operation of the flag 53 based on signals transmitted from the tray sensor 50. If the flag 53 begins to be pushed, the controller 70 controls driving of the motor 40 to allow the print media P to be moved in a given discharge direction. The motor 40 is connected to the conveyor belt 30 and in turn, the conveyor belt 30 is adapted to be rotated clockwise or counterclockwise according to driving of the motor 40.

If the flag 53 is released from a pushed state thereof, the controller 70 controls driving of the motor 40 to allow the print media P to be moved in the given discharge direction until a predetermined time (hereinafter, referred to as a "first time") passes from a pushed state release time. Since the print media P is not yet completely seated on the bookbinding stack tray 13 at the pushed state release time of the flag 53, it may be necessary to continuously move the print media P in the given discharge direction for the first time (i.e. to move the conveyor belt 30 in a first direction).

After the flag 53 is released from the pushed state thereof and the print media P is moved in the given discharge direction for the first time, the controller 70 drives the motor 40 in a reverse direction to move the print media P in an opposite direction of the discharge direction for a predetermined time (hereinafter, referred to as a "second time") (i.e. to move the conveyor belt 30 in a second direction).

Figure 5A:
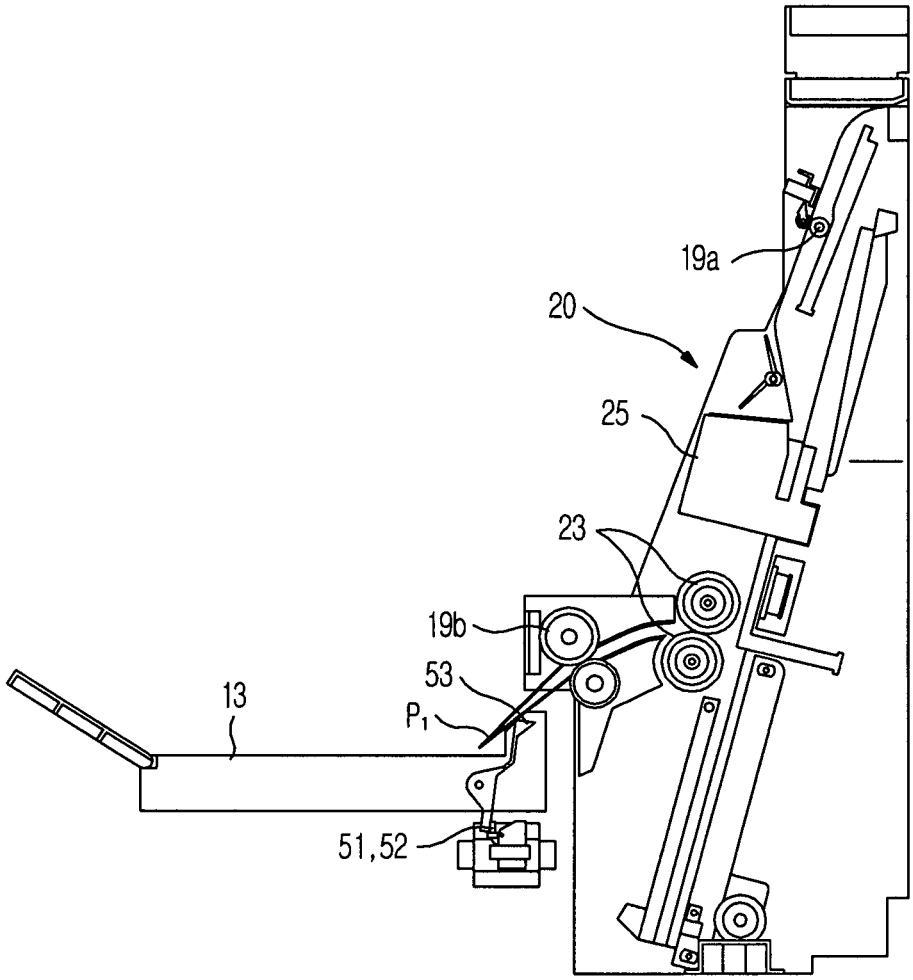
FIGS. 5A to 5H are views illustrating a method to stack print media in the print-medium post-treatment apparatus according to the exemplary embodiment.
Figure 5B:
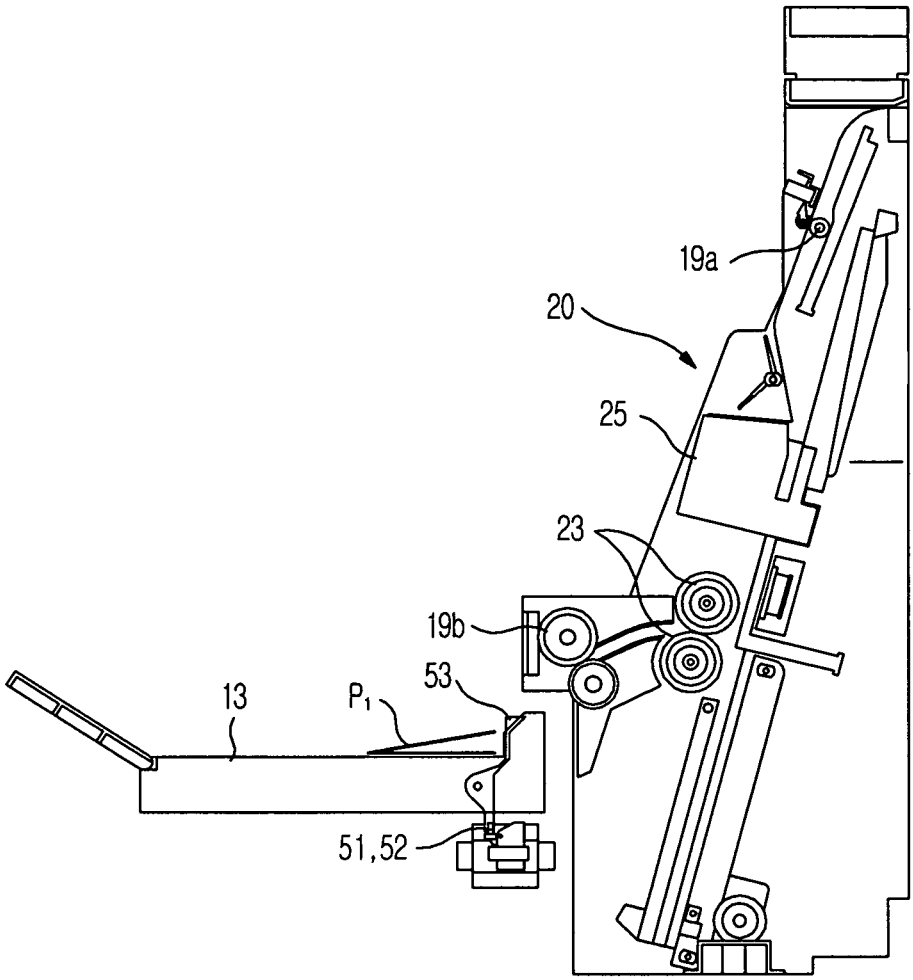
Figure 5C:
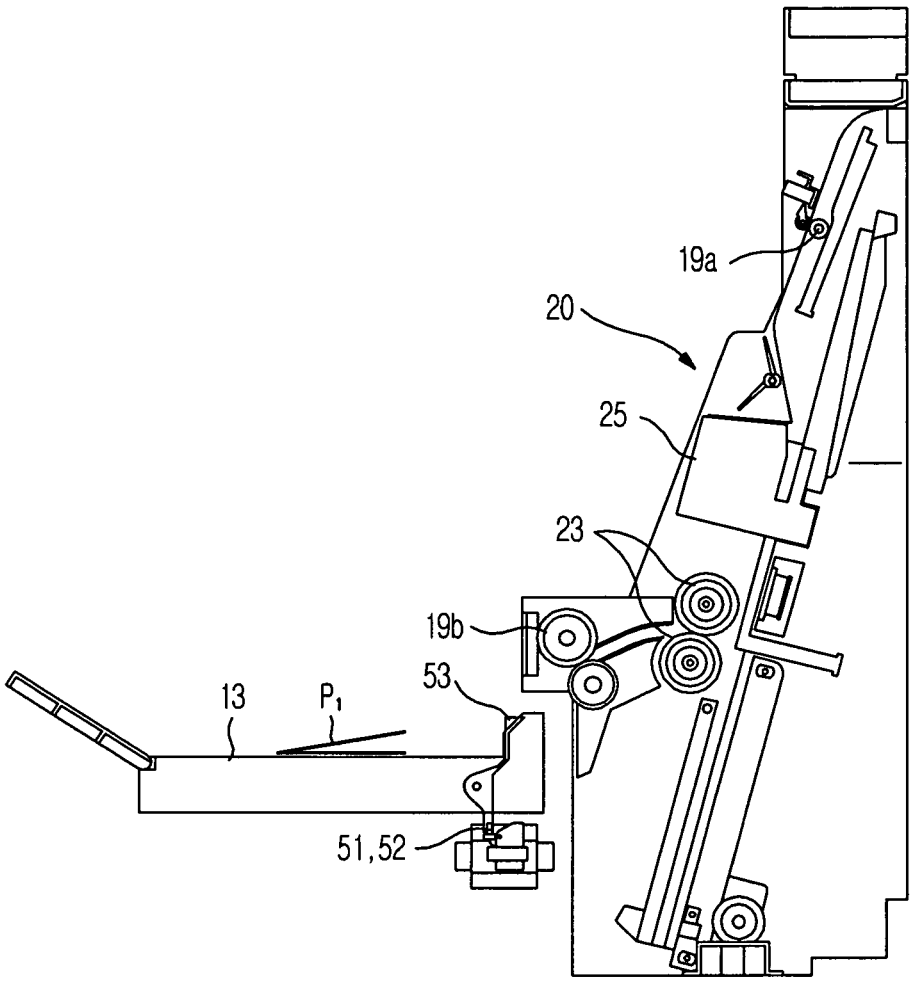
Figure 5D:
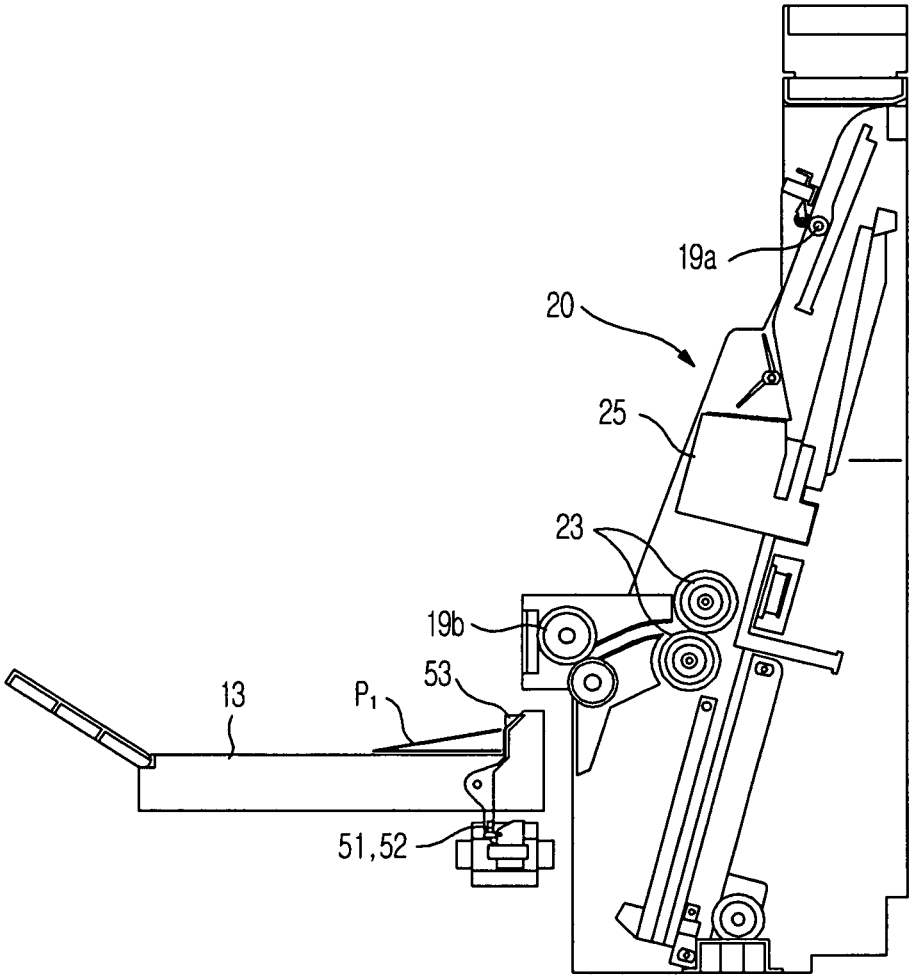
Figure 5E:
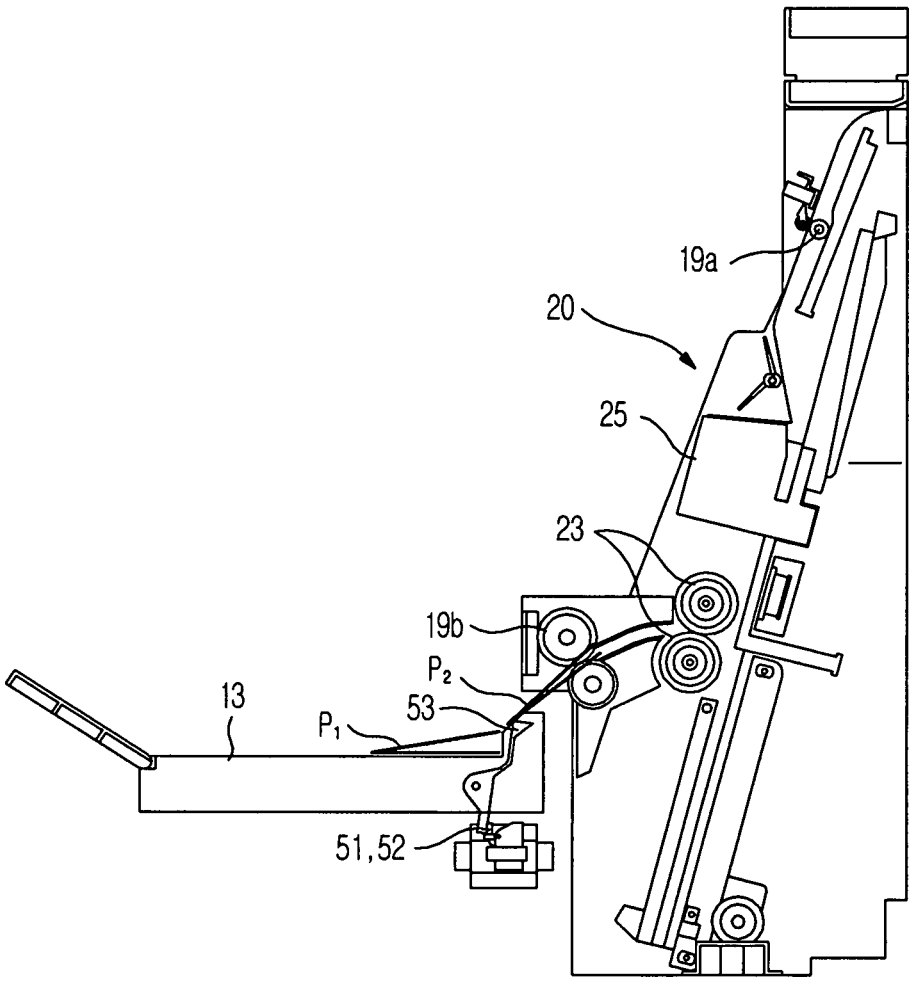
Figure 5F:
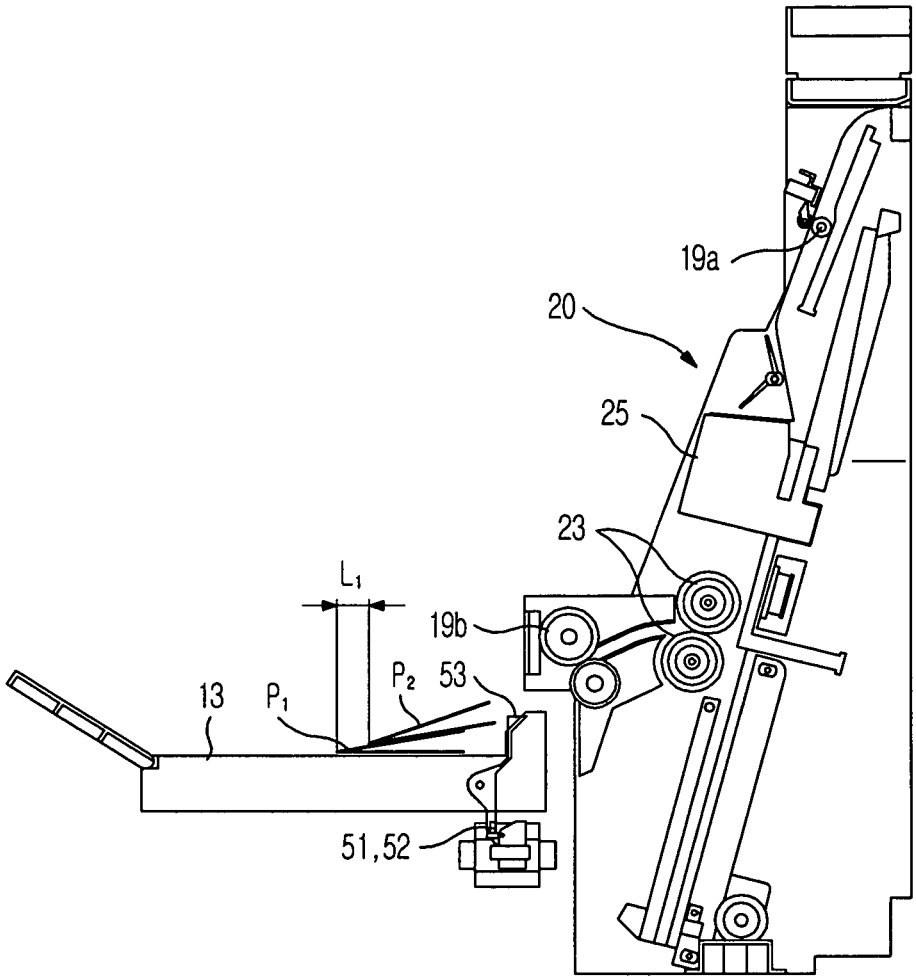
Figure 5G:
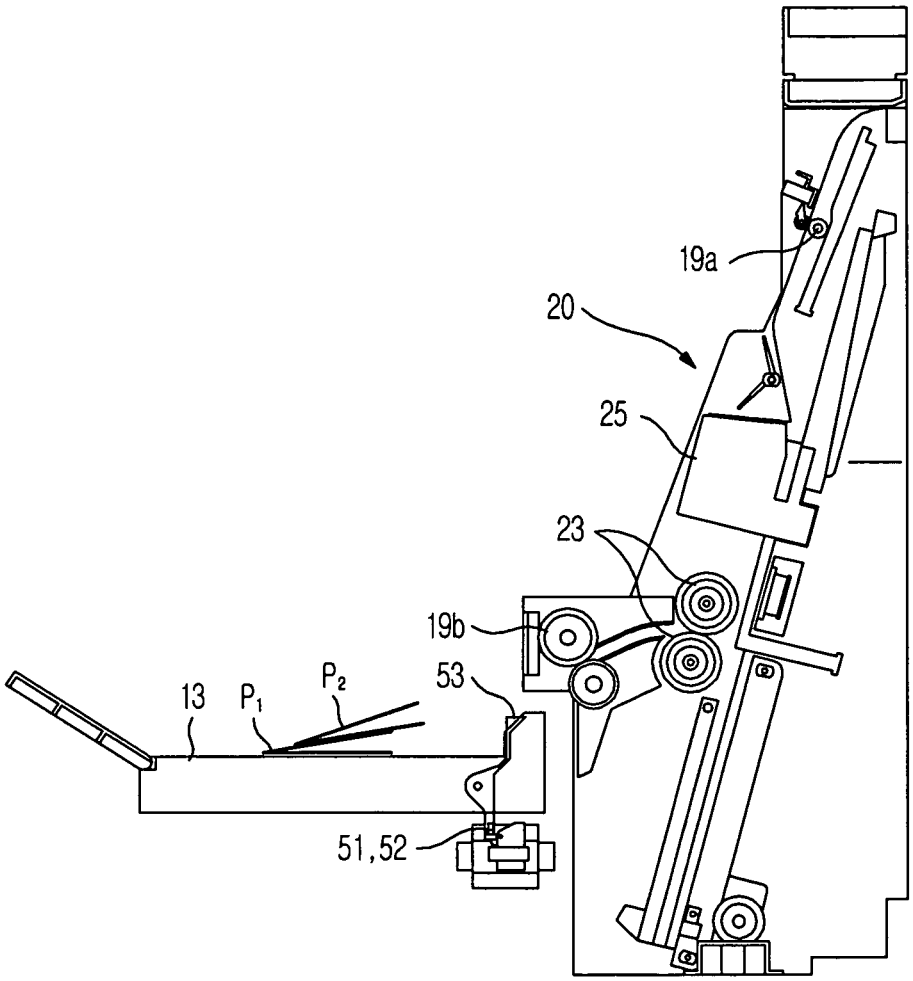
Figure 5H:
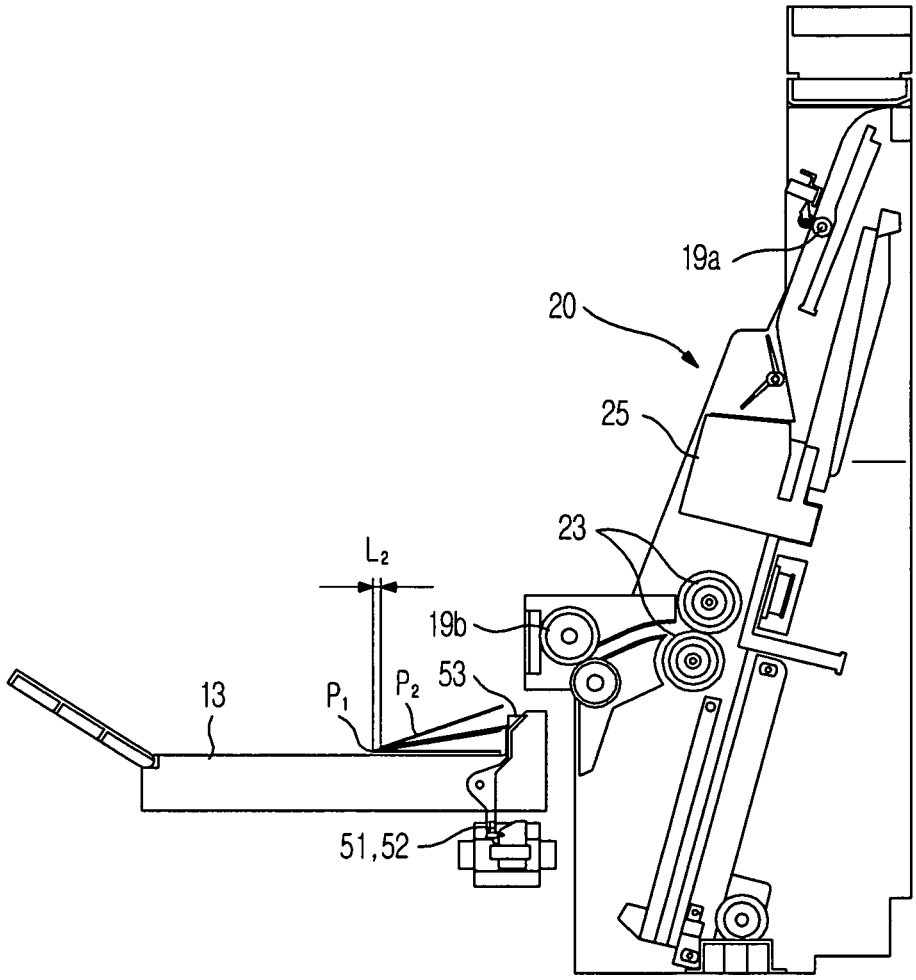

When a front stack of print media P1 is moved in the opposite direction of the discharge direction for the second time, a distance between the previously discharged front stack of print media P1 and a subsequently discharged stack of print media P2 is reduced. Hereinafter, the reason for this will be described in detail with reference to FIGS. 5A to 5H. FIG. 5A illustrates an operation in which the motor 40 is driven as the front stack of print media P1 pushes the flag 53, thus causing the front stack of print media P1 to be moved in the given discharge direction by operation of the conveyor belt 30. FIG. 5B illustrates an operation in which a trailing end of the front stack of print media P1 passes through the flag 53 thus allowing the flag 53 to be released from the pushed state thereof. FIG. 5C illustrates an operation in which the front stack of print media P1 is moved in the given discharge direction for the first time so as to be completely discharged from the bookbinding device 20 after the flag 53 is released from the pushed state thereof. FIG. 5D illustrates an operation in which the motor 40 is driven in a reverse direction for the second time, thus causing the front stack of print media P1 to be moved in an opposite direction of the discharge direction. FIG. 5E illustrates an operation in which the motor 40 is driven as a following stack of print media P2 pushes the flag 53, thus causing the conveyor belt 30 to begin to move both the stacks of print media P1 and P2 in the given discharge direction. FIG. 5F illustrates an operation in which a trailing end of the following stack of print media P2 passes through the flag 53 thus allowing the flag 53 to be released from the pushed state thereof. The following stack of print media P2 is seated on the previously discharged front stack of print media P1 to overlap a part of an upper end of the stack of print media P1 (by a length corresponding to a distance L1 between the successively discharged stacks of print media P1 and P2). FIG. 5G illustrates an operation in which the overlapped stacks of print media P1 and P2 are moved in the given discharge direction for the first time. FIG. 5H illustrates an operation in which the motor 40 is driven in a reverse direction for the second time, thus causing the stacks of print media P1 and P2 to be moved in the opposite direction of the discharge direction. It will be appreciated that the distance between the stacks of print media P1 and P2 is reduced as the overlapped stacks of print media P1 and P2 are moved in the opposite direction of the discharge direction (the distance between the successively discharged stacks of print media is reduced from L1 to L2). The previously discharged stack of print media P1 is moved while coming into direct contact with the conveyor belt 30 and therefore, has a larger force to move in the opposite direction of the discharge direction than the subsequently discharged stack of print media P2. This results in a reduction in the distance between the stacks of print media P1 and P2.

Figure 6A:
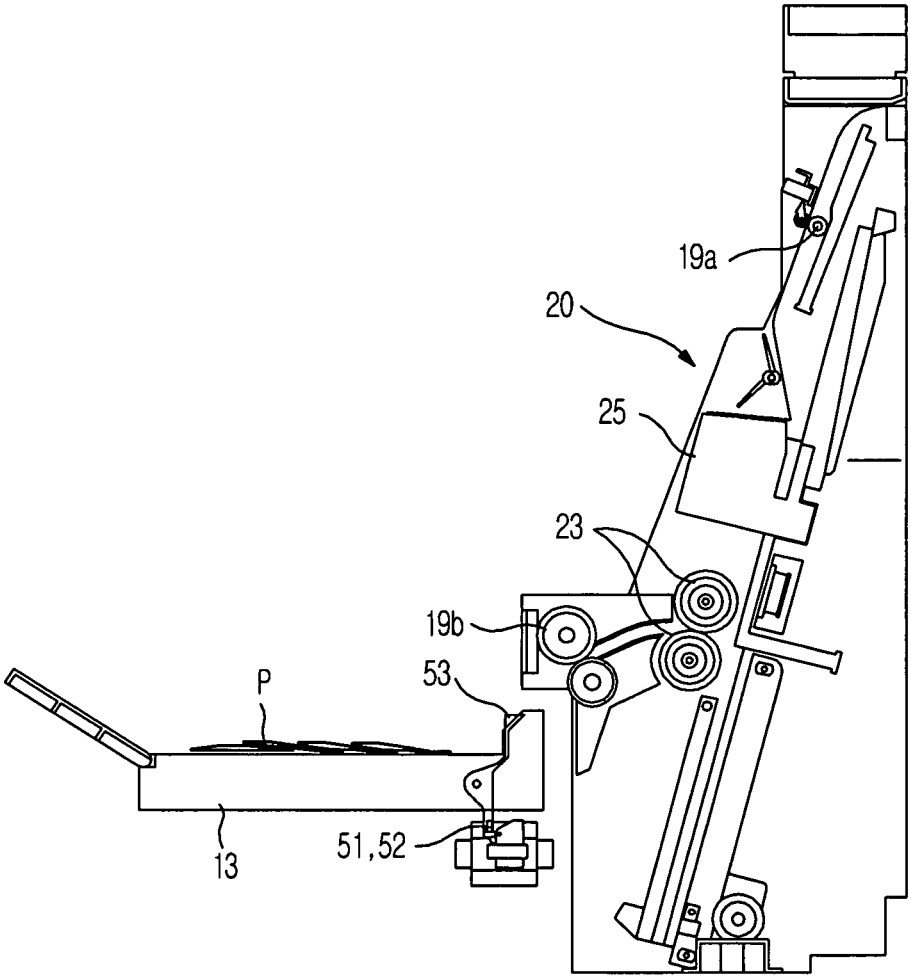
FIG. 6A is a view illustrating print media stacked on a bookbinding stack tray of a unidirectional conveyor belt type.
Figure 6B:
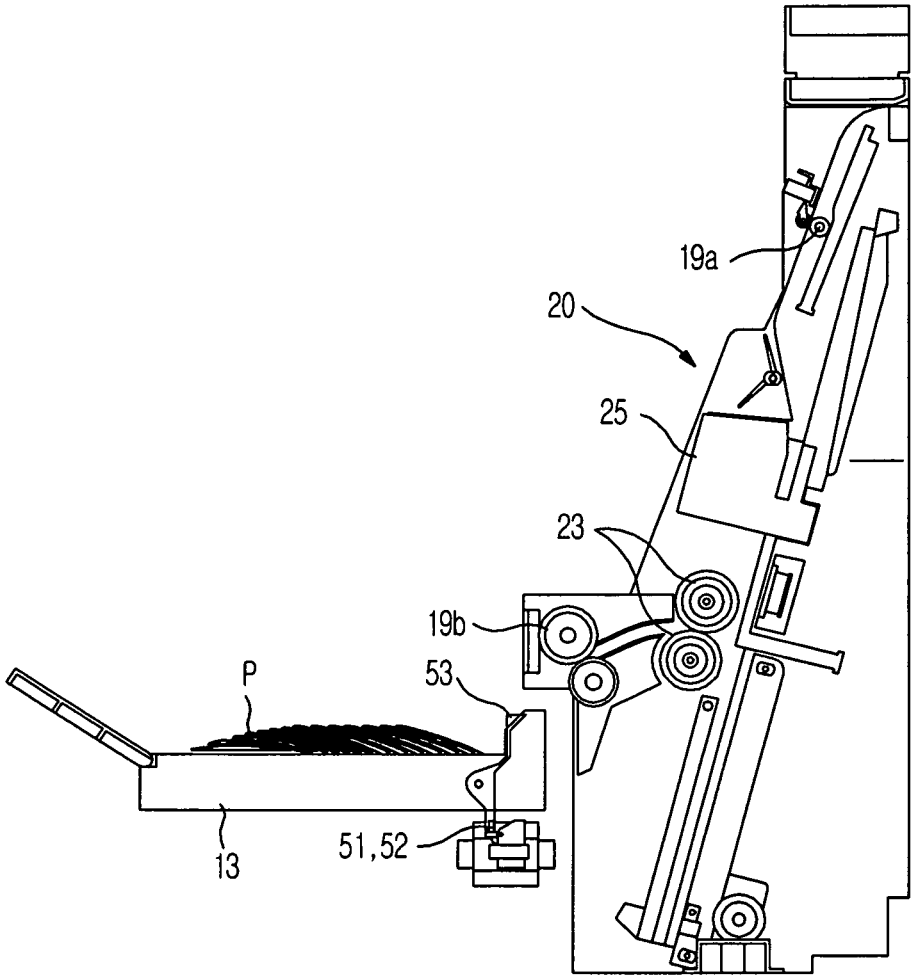
FIG. 6B is a view illustrating print media stacked on a bookbinding stack tray of a bidirectional conveyor belt type.

The above described bi-directional operation of the conveyor belt 30 may reduce the distance between the successively discharged stacks of print media P1 and P2, resulting in an increase in the number of print media P stacked on the bookbinding stack tray 13. This will be described in detail with reference to FIGS. 6A and 6B. FIG. 6A is a view illustrating a plurality of print media P stacked by uni-directional operation of the conveyor belt 30 to move the print media P in the given discharge direction, whereas FIG. 6B is a view illustrating a plurality of print media P stacked by bi-directional operation of the conveyor belt 30 to move the print media P in the given discharge direction and the opposite direction of the discharge direction. As illustrated in FIG. 6B, the distance between the successively discharged stacks of print media P1 and P2 is reduced when the conveyor belt 30 is controlled bi-directionally as described above with reference to FIGS. 5A to 5H, whereby the number of the print media P stacked on the bookbinding stack tray 13 may be increased. That is, differently from uni-directional operation of the conveyor belt 30, the bi-directional operation of the conveyor belt 30 according to the embodiment of the present invention allows the print media P to be moved in the given discharge direction and the opposite direction thereof, achieving a reduced distance between the successively discharged stacks of print media P1 and P2.

Figure 7:
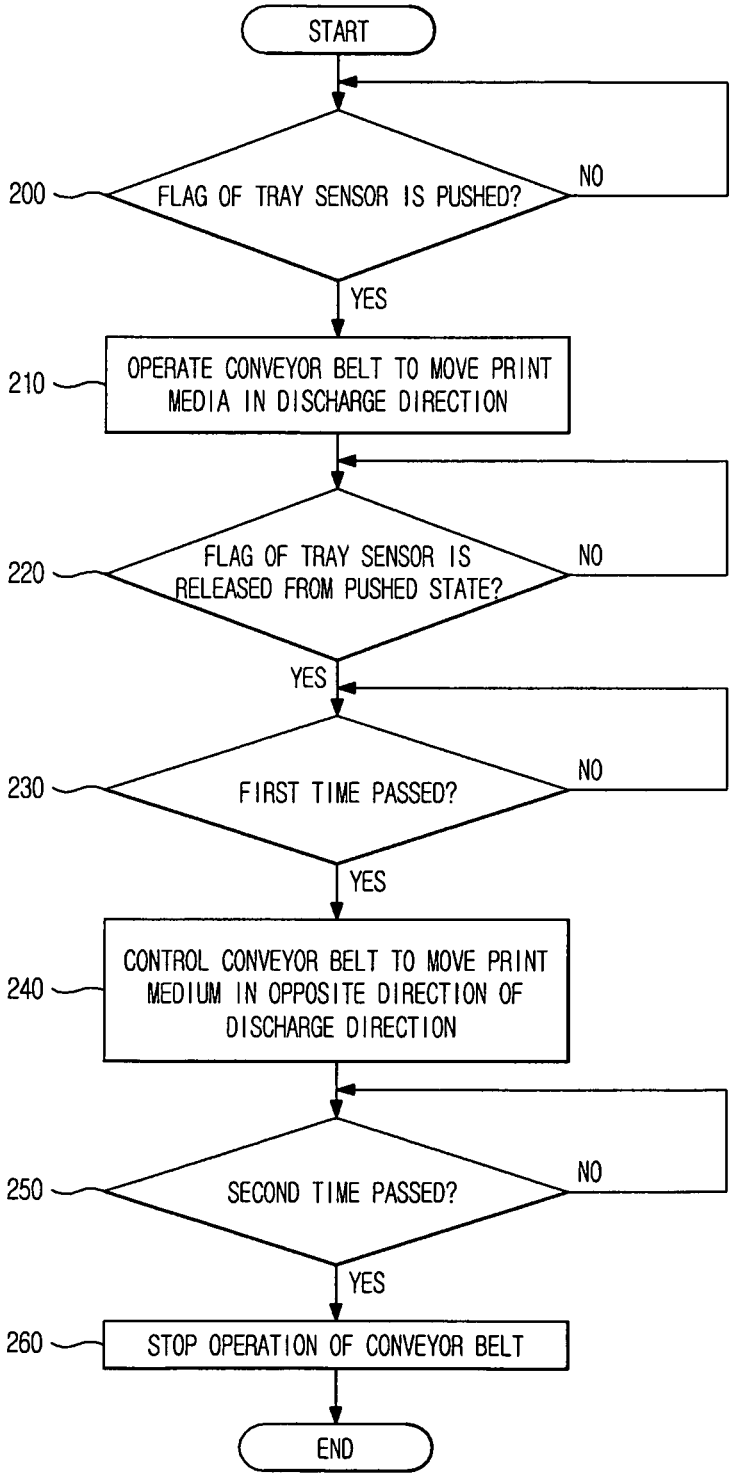
FIG. 7 is a control flow chart of the print-medium post-treatment apparatus according to the exemplary embodiment.

FIG. 7 is a control flow chart illustrating a method to increase the number of print media stacked on the bookbinding stack tray of the print-medium post-treatment apparatus according to the exemplary embodiment.

If the bookbinding device 20 begins to be operated, the controller 70 confirms whether or not the print media P is discharged onto the bookbinding stack tray 13. The discharge of the print media P onto the bookbinding stack tray 13 may be confirmed as the tray sensor 50 installed at one side of the bookbinding stack tray 13 senses the presence of the print media P. Specifically, the discharge of the print media P may be sensed as the flag 53 of the tray sensor 50 is pushed. Alternatively, although the present embodiment describes the tray sensor 50 installed at one side of the bookbinding stack tray 13, the tray sensor 50 may be installed to the body 10 of the print-medium post-treatment apparatus 100 and has no limit in an installation position thereof (200).

Next, after sensing the print media P discharged onto the bookbinding stack tray 13, the controller 70 operates the conveyor belt 30 to move the print media P in the given discharge direction (210).

Next, once the controller 70 confirms that sensing of the print media P by the tray sensor 50 is released, the controller 70 operates the conveyor belt 30 for the first time starting from the sensing release time of the print media P, thus allowing the print media P to be completely discharged from the body 10 of the print-medium post-treatment apparatus 100 and be seated on the bookbinding stack tray 13 (220 and 230). Here, the sensing release of the print media P is confirmed if the flag 53 of the tray sensor 50 is released from the pushed state thereof.

Next, the controller 70 operates the conveyor belt 30 to discharge the print media P in the opposite direction of the discharge direction if the first time has passed. The controller 70 moves the print media P in the opposite direction of the discharge direction for the second time, thus allowing a distance between the previously discharged stack of print media P1 and the subsequently discharged stack of print media P2 to be reduced (240 and 250).

Next, the controller 70 stops operation of the conveyor belt 30 if the second time has passed. In the meantime, to discharge of a plurality of print media P, operations 200 to 260 are repeatedly performed to reduce the distance between the plurality of print media P (260).

As apparent from the above description, according to the exemplary embodiment, an increased number of print media may be stacked on a bookbinding stack tray.

Although the embodiment has been shown and described, it would be appreciated by those skilled in the art that changes may be made in these embodiments without departing from the principles and spirit of the invention, the scope of which is defined in the claims and their equivalents.

What is claimed is:

1. A print-medium post-treatment apparatus comprising:

a bookbinding stack tray including a tray sensor to sense a print medium discharged from a bookbinding device, a conveyor belt to move the print medium, and a motor to operate the conveyor belt; and a controller to move the print medium onto the bookbinding stack tray in a given discharge direction by operating the conveyor belt in a first direction if the tray sensor senses the print medium, and to move the print medium in an opposite direction of the discharge direction by operating the conveyor belt in a second direction so as to reduce a distance between a previously discharged print medium and a subsequently discharged print medium, wherein the tray sensor includes a light emitting element to irradiate light, a light receiving element to receive the irradiated light, and a flag movably installed between the light emitting element and the light receiving element, wherein the tray sensor senses the print medium discharged from the bookbinding device onto the bookbinding stack tray when the print medium pushes the flag, and wherein the controller moves the print medium in the discharge direction by operating the conveyor belt for a first time starting from a time when the print medium releases the flag from a pushed state.

2. The apparatus according to claim 1, wherein the print medium discharged onto the bookbinding stack tray is sensed as the light irradiated from the light emitting element is intercepted or is transmitted to the light receiving element when the print medium pushes the flag.

3. The apparatus according to claim 1, wherein the controller moves the print medium in the opposite direction of the discharge direction for a second time after the print medium is moved in the discharge direction for the first time.

4. A control method of a print-medium post-treatment apparatus comprising:

sensing a print medium discharged from a bookbinding device onto a bookbinding stack tray;

moving the print medium in a given discharge direction by operating a conveyor belt of the bookbinding stack tray in a first direction if the print medium is sensed; and moving the print medium in an opposite direction of the discharge direction by operating the conveyor belt in a second direction so as to reduce a distance between a previously discharged print medium and a subsequently discharged print medium, wherein the movement of the print medium via operation of the conveyor belt in the first direction includes operating the conveyor belt for a predetermined time starting from a time when the print medium discharged from the bookbinding device onto the bookbinding stack tray is sensed, thereby moving the print medium in the discharge direction.

5. The control method according to claim 4, wherein the movement of the print medium in the opposite direction of the discharge direction via operation of the conveyor belt in the second direction includes operating the conveyor belt in the second direction for a predetermined time after the conveyor belt is operated in the first direction for the predetermined time.

6. A control method of a print-medium post-treatment apparatus comprising:

sensing a print medium discharged from a bookbinding device onto a bookbinding stack tray;

moving the print medium in a given discharge direction by operating a conveyor belt of the bookbinding stack tray in a first direction if the print medium is sensed; and moving the print medium in an opposite direction of the discharge direction by operating the conveyor belt in a second direction so as to reduce a distance between a previously discharged print medium and a subsequently discharged print medium wherein:

the bookbinding stack tray is provided with a tray sensor; and the conveyor belt is operated in the first direction if the tray sensor senses the print medium, and wherein:

it is confirmed whether or not the tray sensor does not sense the print medium; and the conveyor belt is operated in the first direction for the predetermined time starting from a time when the tray sensor does not sense the print medium.

7. The control method according to claim 6, wherein the conveyor belt is operated in the second direction for the predetermined time to move the print medium in the opposite direction of the discharge direction after the conveyor belt is moved in the first direction for the predetermined time.

8. A print-medium post-treatment apparatus arranged parallel to an image forming apparatus, the print-medium post-treatment apparatus comprising:

a bookbinding stack tray including a tray sensor to sense a print medium discharged from a bookbinding device, a conveyor belt to move the print medium, and a motor to operate the conveyor belt;

a receiver to receive signals from the image forming apparatus;

a controller to control bi-directional movement of the conveyor belt so as to increase the number of print media stacked on the bookbinding stack tray;

a memory to store drive time information of the conveyor belt;

a drive unit to drive the motor connected to the conveyor belt to perform bi-directional driving under the control of the controller, wherein the tray sensor includes a light emitting element to irradiate light, a light receiving element to receive the irradiated light, and a flag movably installed between the light emitting element and the light receiving element, wherein the tray sensor senses the print medium discharged from the bookbinding device onto the bookbinding stack tray when the print medium pushes the flag, wherein the tray sensor senses the print medium discharged from the bookbinding device onto the bookbinding stack tray when the print medium pushes the flag, and wherein the controller moves the print medium in the discharge direction by operating the conveyor belt for a first time starting from a time when the print medium releases the flag from a pushed state.

9. The apparatus according to claim 8, wherein the print medium discharged onto the bookbinding stack tray is sensed as the light irradiated from the light emitting element is intercepted or is transmitted to the light receiving element when the print medium pushes the flag.

10. The apparatus according to claim 8, wherein the controller moves the print medium in the opposite direction of the discharge direction for a second time after the print medium is moved in the discharge direction for the first time.

* * * * *

UNITED STATES PATENT AND TRADEMARK OFFICE

CERTIFICATE OF CORRECTION

PATENT NO. : 8,616,542 B2
APPLICATION NO. : 12/929872
DATED : December 31, 2013
INVENTOR(S) : Min et al.

It is certified that error appears in the above-identified patent and that said Letters Patent is hereby corrected as shown below:

On the Title Page Item [57] (Abstract), Line 4, delete "The a" and insert -- The --, therefor.

Signed and Sealed this
First Day of July, 2014

Michelle K. Lee

Michelle K. Lee
*Deputy Director of the United States Patent and Trademark Office*